US005634675A

United States Patent [19]

Mo

[11] Patent Number: 5,634,675

[45] Date of Patent: Jun. 3, 1997

[54] LATCH FOR BATTERY COMPARTMENT

[75] Inventor: Michael Mo, Taipei Hsien, Taiwan

[73] Assignee: Dialer & Business Electronic Co., Ltd., Taipei Hsien, Taiwan

[21] Appl. No.: 506,956

[22] Filed: Jul. 28, 1995

[51] Int. Cl.[6] ..... E05C 19/06

[52] U.S. Cl. ..... 292/80; 292/87; 220/284

[58] Field of Search ..... 292/80, 81, 87, 292/19, DIG. 38, 91, 254, DIG. 63; 220/284

[56] References Cited

U.S. PATENT DOCUMENTS

| | | | |
|---|---|---|---|
| 3,954,201 | 5/1976 | Ostrowsky et al. | 292/DIG. 38 X |
| 4,408,914 | 10/1983 | Ciesiel et al. | 292/DIG. 38 X |
| 4,653,783 | 3/1987 | Steup | 292/19 |
| 5,285,229 | 2/1994 | Kamata | 220/284 X |

FOREIGN PATENT DOCUMENTS

| | | | |
|---|---|---|---|
| 1362541 | 8/1974 | United Kingdom | 220/284 |

*Primary Examiner*—Rodney M. Lindsey
*Attorney, Agent, or Firm*—Bacon & Thomas

[57] ABSTRACT

The cover of a battery compartment is releaseably secured by a compressible U-shaped latch carried by the cover and provided with a pair of projections for engaging a side wall of the battery compartment. Both the side wall and latch are provided with corresponding recesses which define an opening for receiving a pointed object to compress the latch and release the projections.

1 Claim, 2 Drawing Sheets

LATCH FOR BATTERY COMPARTMENT

BACKGROUND OF THE INVENTION

A conventional covering means for a battery compartment usually includes a cover and sliding rails onto which the cover is forcely fitted. A user trying to open the battery compartment cover might very possibly injure his fingers. As a result, the American UL standards require that a battery compartment cover must be so designed that it can be opened only with a certain tool instead of the user's finger to prevent any possible injury to the finger during opening of the battery compartment cover. Battery compartment covers having a structure which allows the cover to be opened only by a certain tool were largely developed in response to this requirement. For example, most battery compartment covers are now designed to engage with the battery compartment by means of screws and therefore must be removed from the battery compartment by means of at least a screwdriver. This is obviously inconvenient and time-consuming. The small screws that are usually used to fasten the battery compartment covers may drop out and are not easily located again. Or, a small-size screwdriver is not always available when the battery compartment cover is occasionally opened. Moreover, the fine threads on the cover as well as on the screws are easily broken during the closing or opening operation of the battery compartment cover. It is therefore desirable to develop a latch means for the battery compartment cover which is simple in structure, economical in cost, effective in performance, and safe in use, while meeting the requirement of American UL standards for opening only by a certain tool instead of by the fingers.

SUMMARY OF THE INVENTION

It is a primary object of the present invention to provide a battery compartment cover latch means which is simple in structure, economical in cost, effective in performance, and safe in use, while meeting the requirement of American UL standards for opening only by a certain tool which is, however, not limited to a certain particular tool.

To achieve the above object, the present invention provides a latch means for a cover of a battery compartment including an elastic U-shaped latch body extending outwardly and downwardly from a front edge of the battery compartment cover. The U-shaped latch body has an outer surface on a top edge thereof. A ledge with a first semicircular dent is provided to correspond to a complementary edge portion formed on a side wall of the battery compartment facing the front edge of the battery compartment cover. The complementary edge portion is formed with a second semicircular dent which together with the first semicircular dent form a circular opening when the battery compartment cover is covered to close the battery compartment. The circular opening is suitable for anything having a pointed end to be inserted therein for causing the elastic U-shaped latch body to disengage from the complementary edge portion of the battery compartment side wall so that the battery compartment cover is opened.

DETAILED DESCRIPTION OF THE PREFERRED EMBODIMENT

Figure 1:
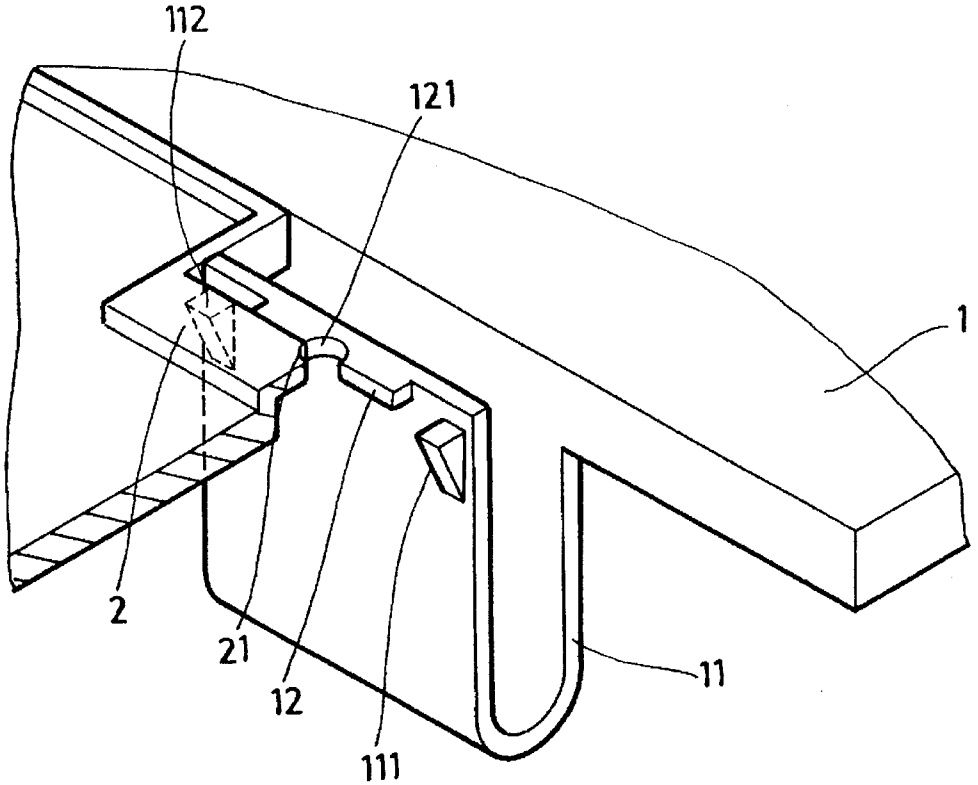
FIG. 1 is a fragmentary, enlarged perspective view showing the structure of the present invention.

Please refer to FIG. 1. The present invention relates to a latch means for a cover 1 of a battery compartment. The latch means mainly includes an elastic U-shaped latch body 11 which is so formed that it extends outwardly and downwardly from a front edge of the cover 1. The latch body 11 is made of suitable material having sufficient compressible elasticity and ultimate strength without being easily broken under pressure. Two projections 111, 112 are molded on an outer surface of the U-shaped latch body 11 near two upper outer corners thereof. A ledge 12 extends forward from a top edge of the outer surface of the U-shaped latch body 11 and is provided at a proper position with a semi-circular recess 121.

A complementary edge portion 2 is formed on a side wall of the battery compartment facing and corresponding to the front edge of the U-shaped latch body 11. A semi-circular recess 21 is also formed on the complementary edge portion 2 so that the two semi-circular recesses 121, 21 together form a circular opening when the battery compartment cover 1 is covered to the battery compartment with the ledge 12 of the latch body 11 of the cover 1 and the complementary edge portion 2 on the side wall of the battery compartment engaging with each other. Anything having a pointed end, such as a conventional ball pen, a toothpick, a clip, etc., slightly smaller than the circular opening can be conveniently used to insert into this circular opening. When the size or area of either the complementary edge portion 2 or the ledge 12 is big enough, a circular opening can be directly formed on any one of these two components with the same effect as that provided by the circular opening formed from the two corresponding semi-circular recesses.

Figure 2:
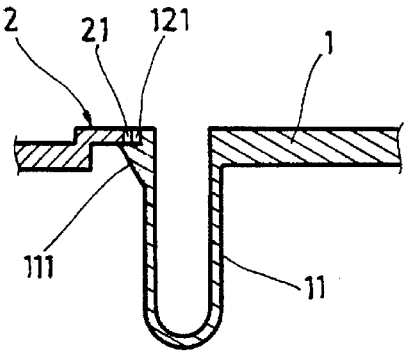
FIG. 2 is a sectional view showing the present invention in a latched position.

To engage the cover 1 into the battery compartment so as to close the battery compartment, first compress the U-shaped latch body 11 backward. Due to the elasticity of the U-shaped latch body 11, the two projections 111, 112 on the outer surface of the latch body 11 can be forced to bypass the complementary edge portion 2 and firmly abut against a bottom surface of the complementary edge portion 2 when the U-shaped latch body 11 springs back forward to its original position, as shown in FIG. 2, and thereby, the cover 1 is firmly covered to the battery compartment and can not be opened just by fingers.

Figure 3:
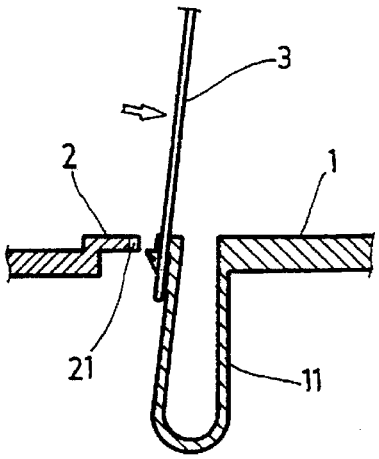
FIGS. 3 and 4 are sectional views showing the manner in which the present invention is unlatched.
Figure 4:
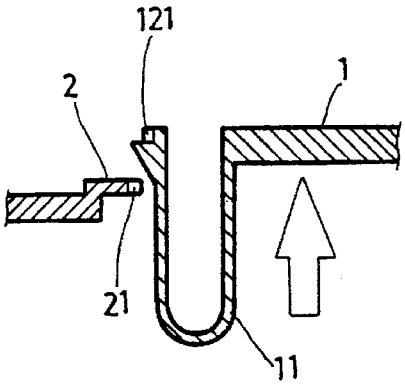

Please now refer to FIGS. 3 and 4. To open the battery compartment cover 1, a tool 3, which is not limited to a particular tool but can be anything having a pointed end, such as a ball pen, a clip, or a toothpick, being slightly smaller than the circular opening formed from the two semi-circular dents 121, 21, respectively on the latch body 11 and the complementary edge portion 2, can be used to insert into the circular opening. Use the tool 3 to compress the outer surface of the U-shaped latch body 11 backward while exerting an upward force to the battery compartment cover 1, the two projections 111, 112 are disengaged from the bottom surface of the complementary edge portion 2 of the battery compartment, and the cover 1 can be easily opened.

What is claimed is:

1. A latch assembly for detachably securing a front edge of a cover to an edge portion of a battery compartment sidewall, which assembly comprises:

a) an elastic U-shaped body for extending from the front edge of the cover, the body including a ledge provided with a first recess formed therein and a projection means for detachable engagement with the edge portion of the battery compartment sidewall; and b) a second recess for location in the edge portion of the battery compartment sidewall, the first and second recesses collectively defining an opening for receiving a pointed tool to compress the body and disengage the projection means from the edge portion of the battery compartment sidewall.

* * * * *